US010538870B2

(12) United States Patent
Beyer

(10) Patent No.: US 10,538,870 B2
(45) Date of Patent: Jan. 21, 2020

(54) DYE EXHAUSTION AND DRYER APPARATUS

(71) Applicant: Bekir Beyer, Istanbul (TR)

(72) Inventor: Bekir Beyer, Istanbul (TR)

( * ) Notice: Subject to any disclaimer, the term of this patent is extended or adjusted under 35 U.S.C. 154(b) by 0 days.

(21) Appl. No.: 16/277,503

(22) Filed: Feb. 15, 2019

(65) Prior Publication Data

US 2019/0177896 A1 Jun. 13, 2019

Related U.S. Application Data

(63) Continuation of application No. 15/097,997, filed on Apr. 13, 2016, now Pat. No. 10,208,417.

(51) Int. Cl.
*D06B 23/10* (2006.01)
*D06B 23/14* (2006.01)

(52) U.S. Cl.
CPC ..... *D06B 23/14* (2013.01); *D06B 23/10* (2013.01)

(58) Field of Classification Search
CPC ..... D06B 23/10; D06B 23/14
USPC ..... 68/20
See application file for complete search history.

(56) References Cited

U.S. PATENT DOCUMENTS

| | | | |
|---|---|---|---|
| 1,824,885 | A | 9/1931 | Hammond |
| 3,467,135 | A | 9/1969 | Muskalla |
| 3,967,581 | A | 7/1976 | Zirbel |
| 4,860,688 | A | 8/1989 | Nazzarro |
| 5,156,026 | A | 10/1992 | Karetnikov et al. |
| 9,777,417 | B2 | 10/2017 | Beyer |
| 2008/0223352 | A1 | 9/2008 | Ando |
| 2018/0016725 | A1 | 1/2018 | Beyer |

FOREIGN PATENT DOCUMENTS

| | | |
|---|---|---|
| CN | 100427864 | 10/2008 |
| WO | WO1987005343 | 9/1987 |
| WO | WO1998049383 | 11/1998 |
| WO | WO2016118495 | 7/2016 |

OTHER PUBLICATIONS

Authorized officer Shane Thomas, International Search Report/ Written Opinion in PCT/US16/13887 dated Jul. 21, 2016, 24 pages.

*Primary Examiner* — Levon J Shahinian
(74) *Attorney, Agent, or Firm* — Fish & Richardson P.C.

(57) ABSTRACT

An apparatus for dye application to textile manufactures, exhaustion of the applied dye, and drying of the textile manufacture. The apparatus, in some implementations, includes a dye applicator that applies dye evenly to a textile manufacture of varying length, one or more steam release conduits for heating the textile manufacture with applied dye to exhaust the dye, and a blower system to dry the textile manufacture after application of the applied dye.

7 Claims, 3 Drawing Sheets

DYE EXHAUSTION AND DRYER APPARATUS

CROSS-REFERENCE TO RELATED APPLICATIONS

This application is a continuation application of, and claims priority to, U.S. patent application Ser. No. 15/097,997, now U.S. Pat. No. 10,208,417, titled "DYE EXHAUSTION AND DRYER APPARATUS," filed on Apr. 13, 2016. The disclosure of the foregoing application is incorporated herein by reference in its entirety for all purposes.

BACKGROUND

This specification relates dye application to textile manufactures, exhaustion of the applied dye, and drying of the textile manufacture.

During the manufacturing of textile products, such as carpet products, samples of the products are dyed to ensure that the textile product being produced is free of material, chemical or process related problems. Typically, a piece of sampled textile manufacture is dyed and examined before committing to a large amount of production to detect any possible unforeseen problems and ensure the product quality and consistency with the standards. If the dyed sample indicates the textile manufacture being produced is within acceptable specifications, then full production may commence. However, if the dyed sample indicates the textile manufacture being produced is not within acceptable specification, then remedial actions are taken, e.g., yarn problems or colorant deviation are resolved, before going into full production.

Checking a textile manufacture sample for these problems requires dyeing of a full width sample so that the defective, e.g., altered molecular structure or orientation, or contaminated, e.g., chemically different fiber mix, yarn can be traced and replaced from its relative location in the loom. With manufacturers producing textiles on looms 90 inches wide and larger, e.g., looms for upholstery, curtain or carpeting, finding a sample dyeing machine large enough to be able to dye full width sample presents challenges. The process of applying dye to textile manufacture samples, exhaustion of the applied dye, and drying of the textile manufacture is expensive and prone to error.

For example, dyeing and drying may take from 8 to 48 hours depending on the dye house work load and the communication between the departments. Such a process entails weaving a full width of a 15-20 linear feet long sample and sending it to the dye house to be dyed. The sample piece cannot be inspected until it finishes going through the entire dyeing and drying cycle with the batch it is dyed together. This results in production machinery sitting idle during the entire time the sample piece is being handled.

Another check process involves the immersion of a full width piece of the textile manufacture in a large container filled with hot water and colorant. This process is less effective than the prior process, as it typically only reveals problems for a chemically different fiber or yarn mixed in another type of fabric either during spinning or weaving processes. This process may not reveal the defective or contaminated yarn because it only "ring" dyes the fiber surface, i.e., the dye only cosmetically stains the outside of the fiber without fully penetrating the fabric, thus appearing to be consistent with the rest of the batch when, in fact, it is not. The fibers needs to be either boiled in a dye bath or steamed after the dye solution is applied on it for a considerable amount of time for any difference in its dye absorbency to be detected. Subsequently, hidden defects appear when fabric goes through proper production procedure resulting considerable amount of "factory seconds" that cannot be sold at full market value.

SUMMARY

In general, one innovative aspect of the subject matter described in this specification can be embodied in an apparatus, comprising a platform defining a substantially flat top surface upon which a textile manufacture may be received; a first housing in movable disposition relative to the platform such that: the first housing, in a first position, defines a substantially enclosed cavity in which the flat top surface of the platform defines a bottom surface of the substantially enclosed cavity; and the first housing, in a second position, allows access to the top surface of the platform for placement and removal of the textile manufacture; a blower device that, when the first housing is in the first position, is fluidly coupled to the substantially enclosed cavity and blows air into the substantially enclosed cavity when energized; wherein the platform further includes a supply plenum and a return plenum that, when the first housing is in the first position, are fluidly coupled to the substantially enclosed cavity, and wherein the blower device is fluidly coupled to the first plenum so that air is communicated into the substantially enclosed cavity through the supply plenum and communicated from the substantially enclosed cavity through the return plenum; and at least one of the supply plenum and return plenum includes a steam release conduit that, when coupled to steam supply, release steam into the plenum in which the steam release conduit is included, wherein the steam enters the substantially enclosed cavity by the fluid coupling to the substantially enclosed cavity.

Particular embodiments of the subject matter described in this specification can be implemented so as to realize one or more of the following advantages. The dye exhaustion and dryer apparatus results in the uniform application of dye across an entire production sample of textile manufacture, thus reducing or eliminating inconsistent application of dye due to human error. The controlled application of steam followed by a drying cycle greatly reduces sample processing time over the manual application of dye and dye exhaustion and drying. This, in turn, increases precision and application uniformity, and reduces overall dyed sample deliver time.

Furthermore, by processing text strips up to the production width of the textile mill, wasteful, costly and time-consuming check rolls that hold up the fabric forming process are eliminated.

Other advantageous uses of the apparatus include continuous range initial color checking, custom color matching, and new color line development. Furthermore, the apparatus facilitates testing such as qualitative colorant, auxiliary chemicals and topical treatment testing, low-melt fiber performance testing, multi-fiber-tone creel proofing, and latex and tile polymer curing testing.

The details of one or more embodiments of the subject matter described in this specification are set forth in the accompanying drawings and the description below. Other features, aspects, and advantages of the subject matter will become apparent from the description, the drawings, and the claims.

Figure 1:
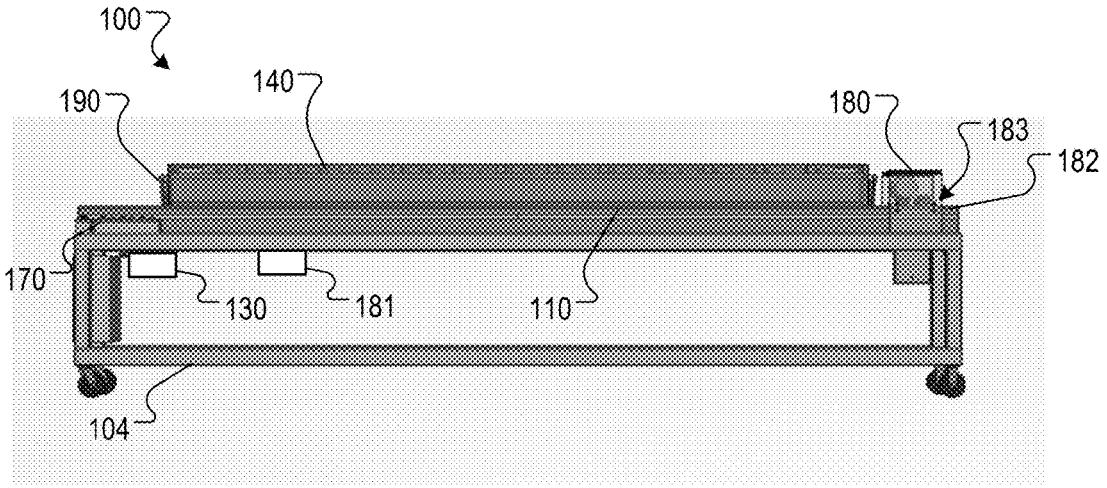
FIG. 1 is a side view of a dyeing and drying apparatus.

Like reference numbers and designations in the various drawings indicate like elements. To avoid congestion in the drawings and for brevity of description, reference numbers may not be repeated in subsequent drawings and descriptions of elements previously described may be omitted in subsequent drawings.

DETAILED DESCRIPTION

Figure 2A:
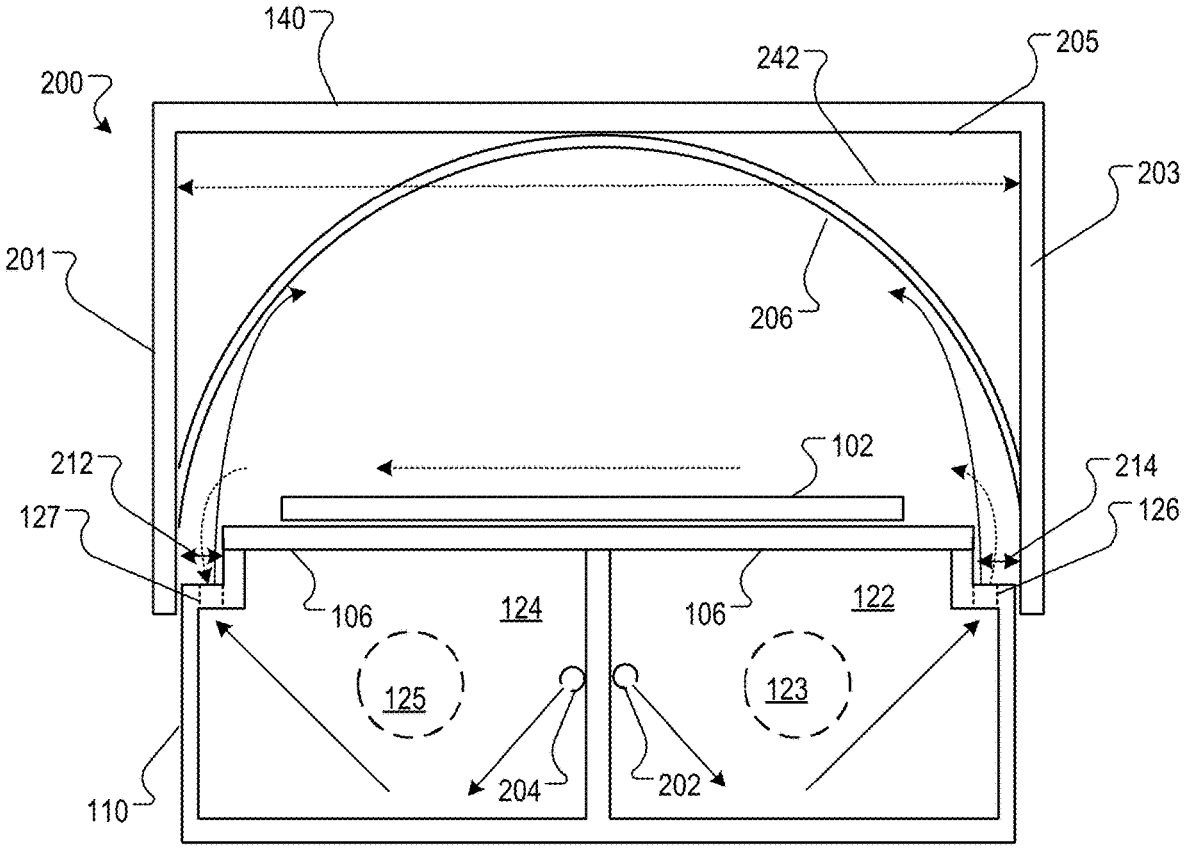
FIG. 2A is a cross-section illustration of one example implementation of the dyeing and drying apparatus.

FIG. 1 is a side view of a dyeing and drying apparatus 100. In FIG. 1, the apparatus 100 is in closed position. The apparatus 100 includes a platform 110 defining a substantially flat top surface 106 upon which a sample may be received. FIG. 2A is a cross-section illustration of one example implementation of the dyeing and drying apparatus 100, and in FIG. 2A a textile manufacture 102, which for brevity shall simply be referred to as a sample 102, is position on the top surface 106 to be processed for dying and drying. The sample may be a carpet sample, a fabric sample, an upholstery sample, or any other textile manufacture for which a dye sampling may be required.

A frame 104 supports the platform 110 and a first housing 140. The first housing 140 is in movable disposition relative to the platform 110 by means of a hinge device 190, such that the first housing 140, in a first position, defines a substantially enclosed cavity in which the flat top surface 106 of the platform 110 defines a bottom surface of the substantially enclosed cavity. In FIG. 1, the first housing 140 is connected to one or more hinge devices 190 such that the movable disposition relative to the platform 110 is rotational. However, other mechanisms to move the first housing 140 into the proper position relative to the platform 110 for dye exhausting and drying can also be used. For example, the first housing 140 can be connected to a vertical elevator device (not shown) such that the movable disposition relative to the platform is elevational.

The first housing 140, in a second position, allows access to the top surface 106 of the platform 110 for placement and removal of the sample 102. When the sample is placed on the top surface 106, a dye applicator carriage 180, which includes a dye applicator 182, deposits dye onto the sample 102. To apply dye to the sample 102, a dye applicator carriage 180 is movably disposed along a longitudinal axis relative to the flat top surface 106 and is configured to deposit dye on sample 102 received on the top surface 106 as the dye applicator carriage 180 traverses the longitudinal axis of the apparatus 100. For example, the carriage 180 may include rollers 183 in engagement with a track 182, and may traverse the platform 110 by means of a driver 181. The driver 181 may be coupled to the carriage by means of a belt, or a screw drive, or any other appropriate driver mechanism.

Figure 2B:
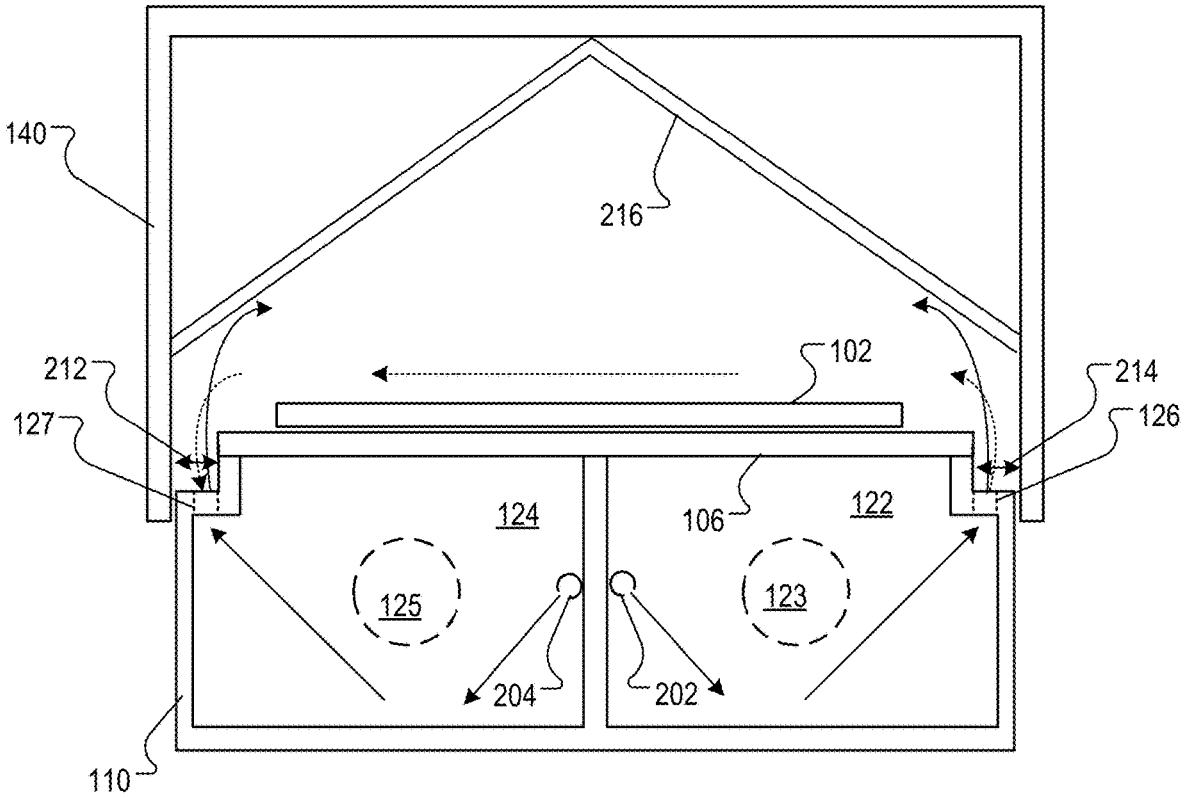
FIG. 2B is a cross-section illustration of another example implementation of the dyeing and drying apparatus.

FIGS. 2A and 2B are illustrations of a first implementation of the interior cavity of the apparatus 100. The cavity is defined by side walls 201 and 203, and ceiling 205. Between the side walls 201 and 203 and the surface 106 are respective gaps. The supply plenum 122 includes a supply hole 123 that is connected to the blower system 130. The return plenum 124 includes an exit hole 125 through which air is exhausted after traversing from the supply plenum 122, through the cavity and into the return plenum 124, as indicated in FIG. 2B. That is, when the first housing 140 is in the first position, the plenums 122 and 124 are fluidly coupled to the substantially enclosed cavity, and the blower system 130 is fluidly coupled to the first plenum 122 so that air is communicated into the substantially enclosed cavity through the supply plenum 122 and communicated from the substantially enclosed cavity through the return plenum 124. The blower system 130 may optionally include heating elements so that the air blown into the supply plenum 122 is heated.

As shown in FIG. 2A, the platform 140 defines a first side 201 and a second side 203 define a first width 242 such that the sides 201 and 203 close over the side walls of the platform 110. The substantially flat top surface 106 is of a second width that is less than the first width and positioned such that a first gap 212 exists between the first side of the platform and a first side of the substantially flat top surface 106 and a second gap 214 exists between the second side of the platform and the second side of the substantially flat top surface. Within the gap 212 an egress 126 of the supply plenum 122 is located, and with the gap 214 an ingress 127 of the return plenum 124 is located. The ingress 126 and egress 127 may run substantially the length of the enclosed cavity so that air may flow evenly through the cavity during the drying process. The ingress 126 and egress 127 allow for entry of steam, described below, but when the blower device is operations, allow for ingress of air into the cavity by the ingress 126 and egress of air from the cavity by the egress 127, as indicated by the dashed directional arrows.

Within the plenums 122 and 124 are steam release conduits 202 and 204 that, when coupled to steam supply (not shown), release steam into the plenums. In some implementations, the steam is released in a downward direction to facilitate venting into the substantially enclosed cavity through the ingress 126 and egress 127. Thus the steam enters the substantially enclosed cavity by fluid coupling, as indicated by the solid direction arrows. The steam heats up the sample 102, and thus the applied dye solution in the sample, and exhausts the dye applied to the sample.

After the dye is exhausted, a control system 170, which is electrically coupled to the blower device and a steam supply control system (e.g., valves that control the steam venting into the conduits 202 and 204), causes the steam supply to not provide steam to the steam release conduits, and energizes a blower device 130 connected to the plenum 122. The blower device 130 is in fluid communication with the enclosed cavity by the supply plenum 122, and hot air is circulated through the cavity, and exits out of the return plenum 124, to dry the sample 102. After drying, the first housing 140 may be opened and the sample 102 removed for inspection.

The control system 170 may be used to manually turn on and turn off the steam supply and the blower device 130. Additionally, the control system 170 can be programmed such that during a first time period, the steam supply provides steam to the steam release conduit and the blower device is de-energized and that, during a second time period after the first time period, the steam supply does not provide steam to the steam release conduit and the blower device is energized.

The first housing 140 may, in some implementations, include sheeting or some other surface that defines an interior housing surface having a geometry that facilitates steam condensation to run downward along the interior housing surface to a side of the enclosed cavity. This reduces or eliminates dripping of water droplets onto the sample 102. The dripping of water droplets can affect the dye exhausting and uniformity of color. As shown in FIG. 2A, the geometry may be curved to define a curved surface 206. However, in FIG. 2B, the geometry may be planar and define acute angles relative to the top surface 106. Other geometries may also be used.

Figure 3A:
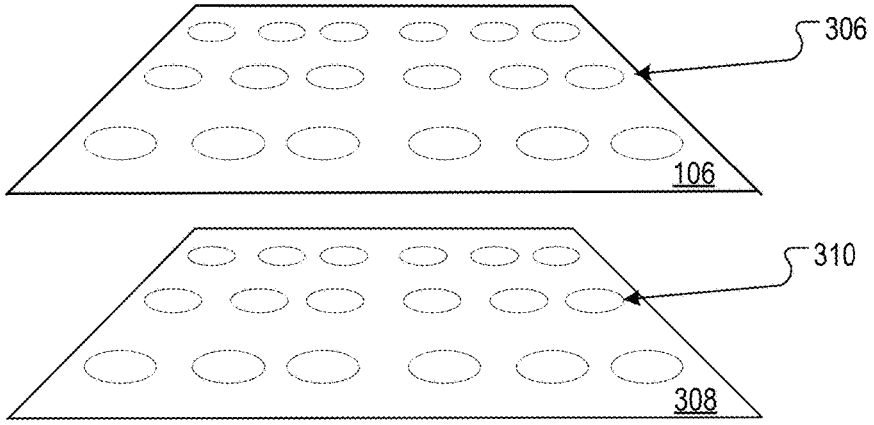
FIG. 3A is an illustration of a perforated top surface of the dyeing and drying apparatus.
Figure 3B:
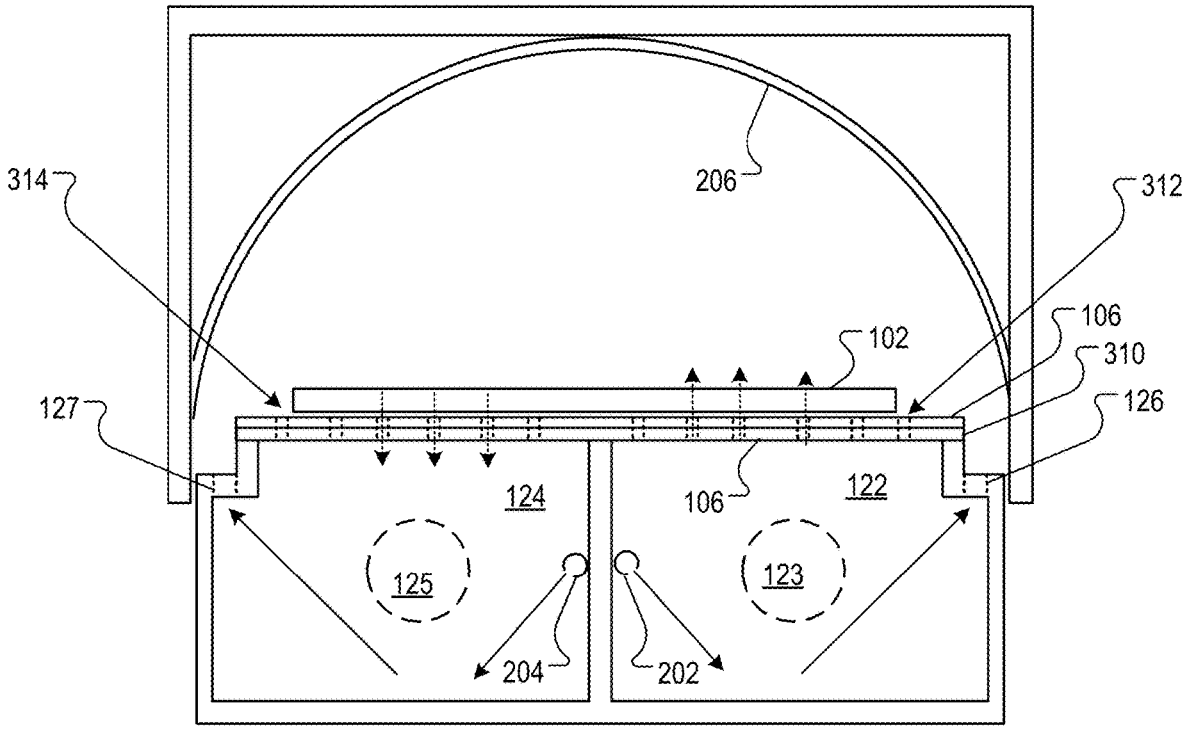
FIG. 3B is a cross-section illustration of the implementation of FIG. 3A.

Another appropriate configuration is shown in FIGS. 3A and 3B. In the implementation of FIGS. 3A and 3B, the substantially flat top surface includes a top surface sheet 106, having first perforations 306, and one or more second sheets 308 having second perforations 310. Each second sheet 308 is in slidable disposition relative to the first sheet 106. For example, the sheets may slide parallel to a longitudinal axis. When each second sheet 308 is slidably disposed in a respective first position, the first and second perforations 306 and 310 are aligned to form a respective egresses 312 for a respective portion of the supply plenum 122 and a respective ingresses 314 for a respective portion of the return plenum 124. Conversely, when each second sheet 308 is slidably disposed in a respective second position, the first and second perforations 306 and 310 are not aligned such that the respective portion of the supply plenum 122 does not have an egress for the second sheet 308 and the respective portion of the return plenum 124 does not have an ingress for the second sheet 308.

During application of the steam, the sheets 106 and 308 are positioned such that the apertures are closed, but during the drying operation the sheets 106 and 308 are positions such they for openings 312 and 314 from the plenums to the enclosed cavity. The openings 312 allow for air to enter through the sample 102, and the openings 314 allow for air to exit through the sample 102. This can further speed up drying time.

Control features of subject matter and the operations described in this specification can be implemented in digital electronic circuitry, or in computer software, firmware, or hardware, including the structures disclosed in this specification and their structural equivalents, or in combinations of one or more of them.

The operations described in this specification can be implemented as operations performed by a data processing apparatus on data stored on one or more computer-readable storage devices or received from other sources. The term "data processing apparatus" encompasses all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application-specific integrated circuit).

While this specification contains many specific implementation details, these should not be construed as limitations on the scope of any features or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims.

What is claimed is:

1. An apparatus, comprising:

a platform defining a substantially flat top surface upon which a textile manufacture may be received;

a first housing in movable disposition relative to the platform such that:

the first housing, in a first position, defines a substantially enclosed cavity in which the flat top surface of the platform defines a bottom surface of the substantially enclosed cavity; and the first housing, in a second position, allows access to the top surface of the platform for placement and removal of the textile manufacture;

a blower device that, when the first housing is in the first position, is fluidly coupled to the substantially enclosed cavity and blows air into the substantially enclosed cavity when energized;

wherein:

the platform further includes a supply plenum and a return plenum that, when the first housing is in the first position, are fluidly coupled to the substantially enclosed cavity through the flat top surface, and wherein:

the supply plenum includes a respective wall portion that defines a supply hole through which the blower device is fluidly coupled to the supply plenum so that air is communicated into the substantially enclosed cavity through the supply hole, and through the supply plenum and the flat top surface;

the return plenum includes a respective wall portion that defines an exit hole, and air communicated into the substantially enclosed cavity is communicated from the substantially enclosed cavity through the return plenum and the flat top surface and exits the return plenum through the exit hole; and the supply plenum and the return plenum are separate plenums that are separated by a divider below the flat stop surface; and at least one of the supply plenum and return plenum includes a steam release conduit that, when coupled to steam supply, release steam into the at least one of the supply plenum and return plenum in which the steam release conduit is included, wherein the steam enters the substantially enclosed cavity by the fluid coupling to the substantially enclosed cavity, and wherein each of the steam release conduit is separate from the supply hole defined in the supply plenum, and separate from the exit hole defined in the return plenum;

wherein:

the platform defines a longitudinal axis, and the supply plenum is located on a first side of the longitudinal axis and the return plenum is located on a second side of the longitudinal axis that is opposite the first side; and the substantially flat top surface comprises a plurality of perforations that couple the supply plenum and the return plenum to the substantially enclosed cavity.

2. The apparatus of claim 1, further comprising a control subsystem electrically coupled to the blower device and a steam supply control system and that, during a first time period, causes the steam supply to provide steam to the steam release conduit and the blower device to be de-energized and that, during a second time period after the first time period, causes the steam supply to not provide steam to the steam release conduit and the blower device to be energized.

3. The apparatus of claim 1, wherein the first housing is connected to one or more hinge devices such that the movable disposition relative to the platform is rotational.

4. An apparatus, comprising:

a platform defining a substantially flat top surface upon which a textile manufacture may be received;

a first housing in movable disposition relative to the platform such that:

the first housing, in a first position, defines a substantially enclosed cavity in which the flat top surface of the platform defines a bottom surface of the substantially enclosed cavity; and the first housing, in a second position, allows access to the top surface of the platform for placement and removal of the textile manufacture;

a blower device that, when the first housing is in the first position, is fluidly coupled to the substantially enclosed cavity and blows air into the substantially enclosed cavity when energized;

wherein:

the platform further includes a supply plenum and a return plenum that, when the first housing is in the first position, are fluidly coupled to the substantially enclosed cavity, and wherein:

the supply plenum includes a respective wall portion that defines a supply hole through which the blower device is fluidly coupled to the supply plenum so that air is communicated into the substantially enclosed cavity through the supply hole, and through the supply plenum;

the return plenum includes a respective wall portion that defines an exit hole, and air communicated into the substantially enclosed cavity is communicated from the substantially enclosed cavity through the return plenum and exits the return plenum through the exit hole; and the supply plenum and the return plenum are separate plenums that are separated by a divider below the flat stop surface; and at least one of the supply plenum and return plenum includes a steam release conduit that, when coupled to steam supply, release steam into the at least one of the supply plenum and return plenum in which the steam release conduit is included, wherein the steam enters the substantially enclosed cavity by the fluid coupling to the substantially enclosed cavity, and wherein each of the steam release conduit is separate from the supply hole defined in the supply plenum, and separate from the exit hole defined in the return plenum;

wherein:

the platform defines a longitudinal axis, and the supply plenum is located on a first side of the longitudinal axis and the return plenum is located on a second side of the longitudinal axis that is opposite the first side;

the platform defines a first side and a second side on the respective sides of the first and second sides of the longitudinal axis and the first and second sides of the platform define a first width;

the substantially flat top surface is of a second width that is less than the first width and positioned relative the longitudinal axis such that a first gap exists between the first side of the platform and a first side of the substantially flat top surface and a second gap exists between the second side of the platform and a second side of the substantially flat top surface; and an egress of the supply plenum is located at the first gap and an ingress of the return plenum is located at the second gap.

5. The apparatus of claim 4, wherein the first housing defines an interior housing surface having a geometry that facilitates steam condensation to run downward along the interior housing surface to a side of the substantially enclosed cavity.

6. The apparatus of claim 5, wherein the geometry is a curved geometry.

7. The apparatus of claim 5, wherein the geometry is a planar geometry defining interior surfaces having respective acute angles relative to the flat top surface.

* * * * *